United States Patent [19]

Ono

[11] 4,178,575

[45] Dec. 11, 1979

[54] INDICATING APPARATUS FOR INDICATING NUMERALS OR LETTERS BY A PLURALITY NUMBER OF INDICATING ELEMENTS

[75] Inventor: Masami Ono, Yamanashi, Japan

[73] Assignee: Tokico Ltd., Kawasaki, Japan

[21] Appl. No.: 815,353

[22] Filed: Jul. 12, 1977

[30] Foreign Application Priority Data

Jul. 15, 1976 [JP] Japan ..... 51-83492

[51] Int. Cl.[2] ..... G09F 9/32

[52] U.S. Cl. ..... 340/764; 340/703; 340/802; 340/378.2

[58] Field of Search ..... 340/336, 324 R, 324 M, 340/378 R, 763, 764, 802, 378.2, 701, 703

[56] References Cited

U.S. PATENT DOCUMENTS

| | | | |
|---|---|---|---|
| 3,186,115 | 6/1965 | Todt et al. | 340/336 |
| 3,267,455 | 8/1966 | McGuire et al. | 340/324 M |
| 3,307,170 | 2/1967 | Aoyama et al. | 340/324 M |
| 3,444,551 | 5/1969 | Winrow | 340/336 |
| 3,469,258 | 9/1969 | Winrow | 340/336 |
| 3,548,403 | 12/1970 | Johnson | 340/324 S |
| 3,924,226 | 12/1975 | Lacy et al. | 340/336 |

*Primary Examiner*—Marshall M. Curtis
*Attorney, Agent, or Firm*—Haseltine, Lake & Waters

[57] ABSTRACT

An indicating apparatus comprises a plurality number of indicating parts respectively having indicating elements which are operated to indicate and maintain their indicating states, indicating element driving circuits provided in respective indicating parts and adapted to drive said indicating elements respectively, a circuit for supplying indicating signals corresponding to an information to be indicated to respective indicating parts, and scanning driving means provided in correspondence with respective indicating parts and adapted to drive the indicating element driving circuits sequentially in a time-division manner in response to said indicating signals.

3 Claims, 6 Drawing Figures

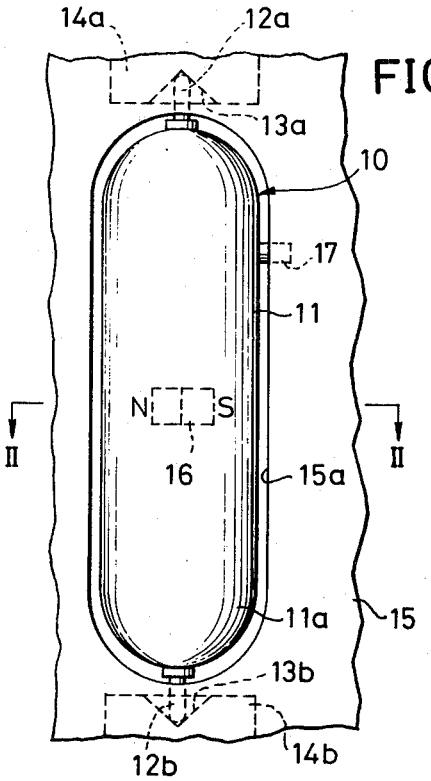
FIG. 1
FIG. 2
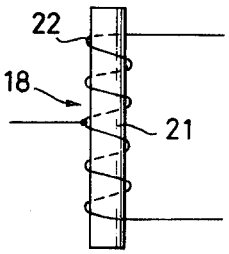
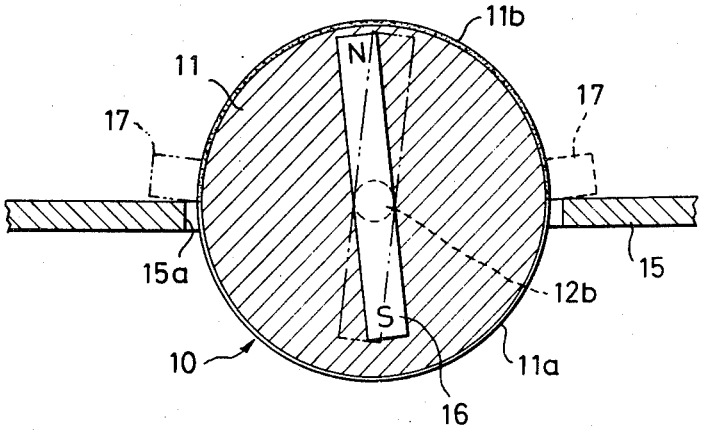

30
Pa
COUNT
C1
CARRY
CO1
COUNT
C2
CARRY
CO2
COUNT
C3
CARRY
CO3
COUNT
C4
CARRY
CO4
COUNT
C5
MULTI-PLEXER
M1
M2
M3
M4
M5
N1
N2
N3
N4
N5
F1
F2
F3
F4
F5
32
FUEL QUANTITY OP CKT
31
INDIC CKT
U1
U2
U3
U4
U5
INDIC ELEMENT DRIV CKT
33
34
FIG DRIV CKT
Tr1
Tr2
Tr3
Tr4
Tr5
G1
G2
G3
G4
G5
t
37
MONO MULTI
Pb
SCANNER
39
FUEL SUPPL APPARATUS
35
38
FLOW METER
36
SW

INDICATING APPARATUS FOR INDICATING NUMERALS OR LETTERS BY A PLURALITY NUMBER OF INDICATING ELEMENTS

BACKGROUND OF THE INVENTION

The present invention relates generally to indicating apparatuses for indicating numerals or leters by a plurality number of indicating elements, and more particularly to an indicating apparatus in which indication is made by a plurality number of indicating elements for self-holding their indicated states which are driven sequentially in time-serial or time-division manner.

In general, as an apparatus for indicating numerals or letters, there has been a so-called seven-elements type indicating apparatus, for instance, in which each numeral is indicated by means of seven indicating elements. In the indicating apparatus of this type known heretofore, electric luminous indicating elements such as luminous tube, photodiode, and liquid crystals have been used. The indicating elements of this type maintain their indication states while an indication driving circuit is being supplied with electric current, but, whereupon the indication driving circuit is rendered into a de-energized state, they become non-indication state whereby the indication disappears. That is, the indicating elements of this type have no self-holding capability of maintaining the indicated states thereof. Therefore, in order to maintain the indicated state, the indication driving circuit must be continuously maintained in an energized state. Accordingly, there arise difficulties that the electric power consumed by the indicating apparatus amounts to a large extent, and the life of the indication driving circuit is shortened. Furthermore, the apparatus referred to above is accompanied with difficulties that, in the case where trouble or failure occurs between the power source and the indication driving circuit due to some reasons, the indication disappears whereby the preceding indicated information becomes unknown.

The indicating apparatus, installed in a fuel filling station, for example, for indicating the quantity of fuel supplied to vehicles is relatively bulky. In particular, in a fuel filling station of the type wherein a fuel supply hose is pulled down from the higher position of a structure such as a ceiling, for fuel filling operation, the indicating apparatus is of large type for being easy to see, because it is installed at a higher position. Accordingly, in such a relatively bulky indicating apparatus, the above described difficulties become noticeable in particular.

SUMMARY OF THE INVENTION

Accordingly, it is a general object of the present invention to provide a novel and useful indicating apparatus in which the above described difficulties have been overcome.

Another object of the present invention is to provide an indicating apparatus in which a plurality number of indicating elements, which maintain indicated state thereof after the indication driving has once carried out, are used, and which is adapted so that said indicating elements are sequentially driven in a time-division manner.

Still another object of the present invention is to provide an indicating apparatus in which each of groups of indicating elements has a structure for capable of indicating each numeral or letter, and respective groups of the indicating elements are sequentially driven in a time-division manner for each numeral or letter.

A further object of the invention is to provide an indicating apparatus in which each of groups of indicating elements indicates each numeral or letter, and, which is adapted to drive a plurality number of indicating elements of each group sequentially in a time-division manner.

Other objects and further features of the invention will be apparent from the following description made in conjunction with the accompanying drawings.

BRIEF DESCRIPTION OF THE DRAWINGS

In the drawings:

FIG. 1 is an elevation showing one embodiment of an indicating element to be used in an indicating apparatus according to the present invention;

FIG. 2 is a plan view of an indicating element in transverse section taken along II—II in FIG. 1;

DETAILED DESCRIPTION

Figure 3:
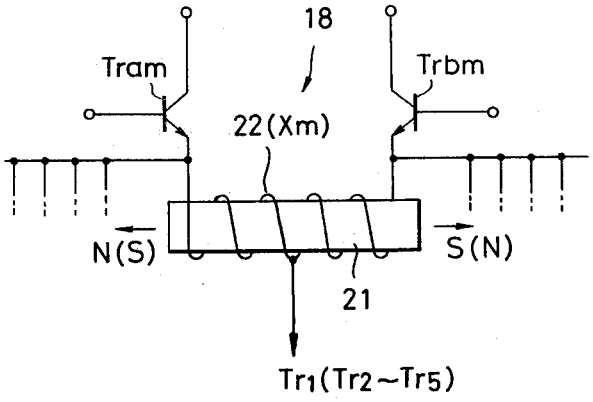
FIG. 3 is a schematic circuit diagram of an electromagnet.

Referring to FIG. 1 through FIG. 4, one embodiment of an indicating element which has a capability of self-holding the indication state thereof and is applied to an indicating apparatus according to the present invention will be described.

An indicating element 10 is composed of a substantially column-shaped indicating rod 11, which is pivotally supported by shaft parts 12*a* and 12*b* respectively fixed to the top and bottom thereof which are respectively engaged in conical recesses 13*a* and 13*b* of bearings 14*a* and 14*b*, as shown in FIG. 1 and FIG. 2. The indicating rod 11 is rotatable in an opening 15*a* formed in an opaque black panel 15. The outer peripheral surface of the indicating rod 11 is colored in such a manner that a white surface 11*a*, for instance, is provided on one semicircle over the whole length thereof, and a black surface 11*b* is provided on the other or remaining semicircle over the whole length thereof. A permanent magnet 16 having magnetic poles at distal ends in longitudinal direction thereof is buried horizontally within the indicating rod 11 through the center thereof. A stop member 17 which comes into contact with a rear surface of the panel 15 is fixed to a border position of the white surface and the black surface of the outer peripheral surface of the indicating rod 11.

An electromagnet 18 is disposed, in confronting with the rear surface of the indicating rod 11, at a height position corresponding to that of the permanent magnet 16. In the state where the stop member 17 is making contact with the rear surface of the panel 15 as indicated in FIG. 2, the longitudinal axis of the permanent magnet 16 is displaced by a small angle with respect to the center line of the electro-magnet 18. Accordingly, the permanent magnet 16 is subjected to a rotational force by a repellent force due to the same polarity with the electromagnet 18 as described hereafter.

The electromagnet 18 is substantially composed of a magnetic core 21 and a coil 22 would therearound, as indicated in FIG. 3. Both ends of the coil 22 are respectively connected to emitters of transistors Tram and Trbm. An intermediate tap is provided at a middle point of the coil 22.

In the state where the white semicircle surface 11*a* of the indication rod 11 is indicated out of the opening 15*a* as shown in FIG. 2, the permanent magnet 16 is at a position where an N pole thereof is in a vicinity of the electromagnet 18. When a current is supplied through the coil 22 for magnetizing the core 21 of the electromagnet 18 in such a manner that the N pole develops at its distal end confronting the indicating rod 11, the N pole of the permanent magnet 16 is subjected to the repellent force by the electromagnet 18. Accordingly, the permanent magnet 16 is caused to rotate, together with the indicating rod 11, counterclockwise in FIG. 2 over a substantially half-revolution until the stop member 17 is brought into contact with the other side of rear surface of the panel 15, that is, the permanent magnet 16 is inverted. When the permanent magnet 16 is rotated, the S pole of the permanent magnet 16 is attracted to the electromagnet 18. Consequently, the black semicircle surface 11*b* of the indicating rod 11 is indicated out of the opening 15*a*.

Thereafter, when the polarities of the core 21 is inverted by reversing the direction in which the current is supplied through the coil 22 of the electromagnet 18, the indicating rod 11 is rotated (inverted) clockwise over a substantially half-revolution and assumes a state indicated in FIG. 2. Every time when the polarities of the electromagnet 18 is inverted, the indicating rod 11 is rotated in the opposite direction so that the surface through the opening 15*a* becomes white or black.

Even if the current is ceased to be supplied to the electromagnet 18 after the indicating element 10 has been inverted, the indicating element 10 is self-held in its inverted state, because it is not subjected to any rotational force. Here, since the core 21 has hysteriesis, the permanent magnet 16 is still attracted by a weak magnetic force of the core 21 even though the current is not supplied to the coil 22 after inverting operation. The indicating rod 11 is therefore held securely at its inverted indicating positions without accompanying any fluctuation. Even if the current to the electromagnet 18 is cut off by accidents such as the failure of power supply, the indicating element 10 maintains its indicating state, similarly as in the preceding case.

Figure 4:
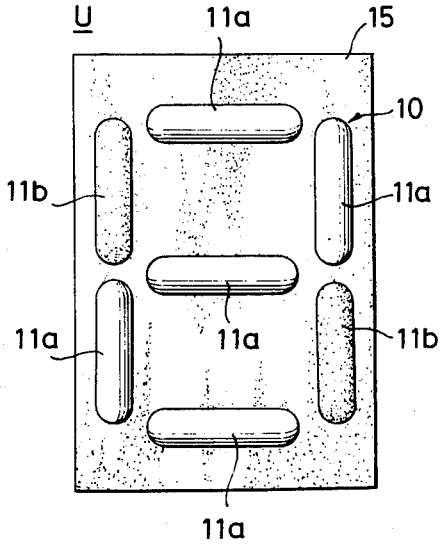
FIG. 4 is an elevation showing one example of one indicating part.

Seven indicating elements, for instance, which are of the above described construction, are arranged into the 8-shaped and organize an indicating part U shown in FIG. 4, whereby a numeral is indicated by means of so-called seven elements. In the example shown in the some figure, two indicating elements face their black surface 11*b* forward, and the remaining five indicating elements face their white surface 11*a* forward, whereby the numeral "2" is relatively indicated.

Figure 5:
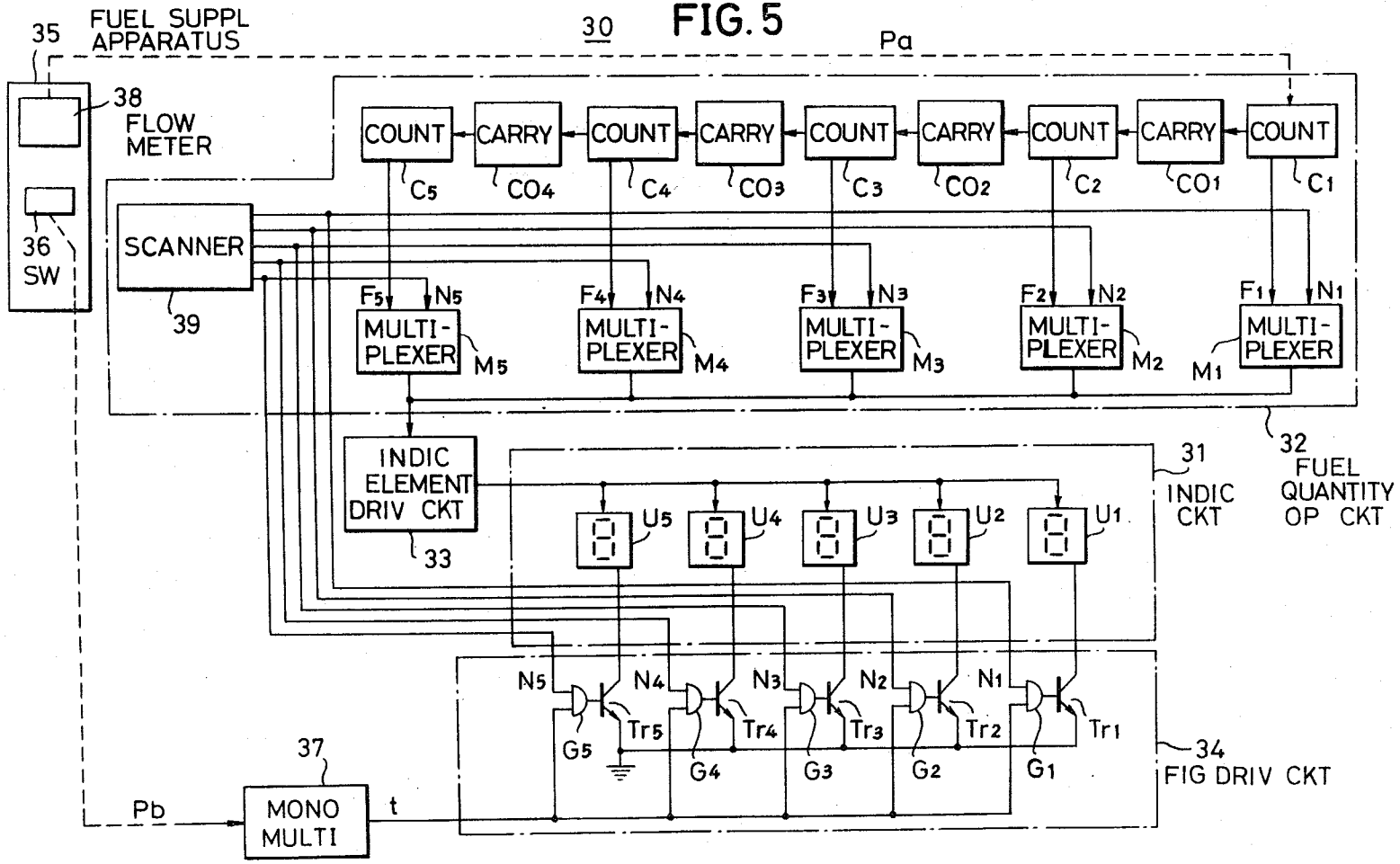
FIG. 5 is a circuit systematic diagram showing one embodiment of a circuit of an indicating apparatus according to the present invention.

One embodiment of the indicating apparatus according to the present invention, using a plurality number of the above described indicating elements, will be described in conjunction with FIG. 5 and FIG. 6. The indicating apparatus of the present embodiment is used for indicating the quantity of fuel supplied at the fuel filling station, for instance.

An indicating apparatus 30 of the present embodiment substantially comprises an indicating circuit 31, a fuel quantity operation circuit 32, an indicating element driving circuit 33, and a figure driving circuit 34. The indicating circuit 31 is composed of indicating parts U1 through U5 of five figures each of which emploies the indicating part U shown in FIG. 4.

When the nozzle (not shown) is take off from the nozzle hanger or when the nozzle at the distal end of the hose suspended from the ceiling is pulled downward to a fuel supplying position for initiating fuel supplying to the vehicle by a fuel supplying apparatus 35, a switch 36 is closed in accordance with the above described operation, and a signal Pb is then supplied from the fuel supplying apparatus 35 to a monstable multivibrator 37. Thereafter, during the fuel supplying operation is continued until the nozzle is hung on the hanger or the nozzle and hose are hoisted, the monostable multivibrator 37 continues its operation, thereby generating a predetermined signal t which is continuously supplied to AND gates G1 through G5 of the figure driving circuit 34.

After fuel supplying is initiated by opening the nozzle valve of the fuel supplying apparatus 35, a signal emitter of a flow meter 38 within the fuel supplying apparatus 35 generates, in response to the flow measurement, a fuel quantity signal Pa which is supplied to a counter C1 of a fuel quantity operation circuit 32. The fuel quantity signal Pa supplied to the counter C1 is transmitted through a carry part CO1 for taking the figure up one place, a counter C2, a carry part CO2, a counter C3, a carry part CO3, a counter C4, a carry part CO4, and a counter CO5. Each counter C1 through C5 operates counting in correspondence to each figure, thereby supplying numeral indicating signals F1 through F5 of each figure to multiplexers M1 through M5, which are respectively constituted with four AND gates, for instance.

A scanner 39 in the operating circuit 32 emits scanning signals N1 through N5 having a period of 80 msec through 120 msec, for instance, sequentially in a time-serial or time-division manner. The scanning signals N1 through N5 are sequentially supplied to the multiplexers M1 through M5 in the fuel quantity operation circuit 32 and to the AND gates G1 through G5 in the figure driving circuit 34.

Figure 6:
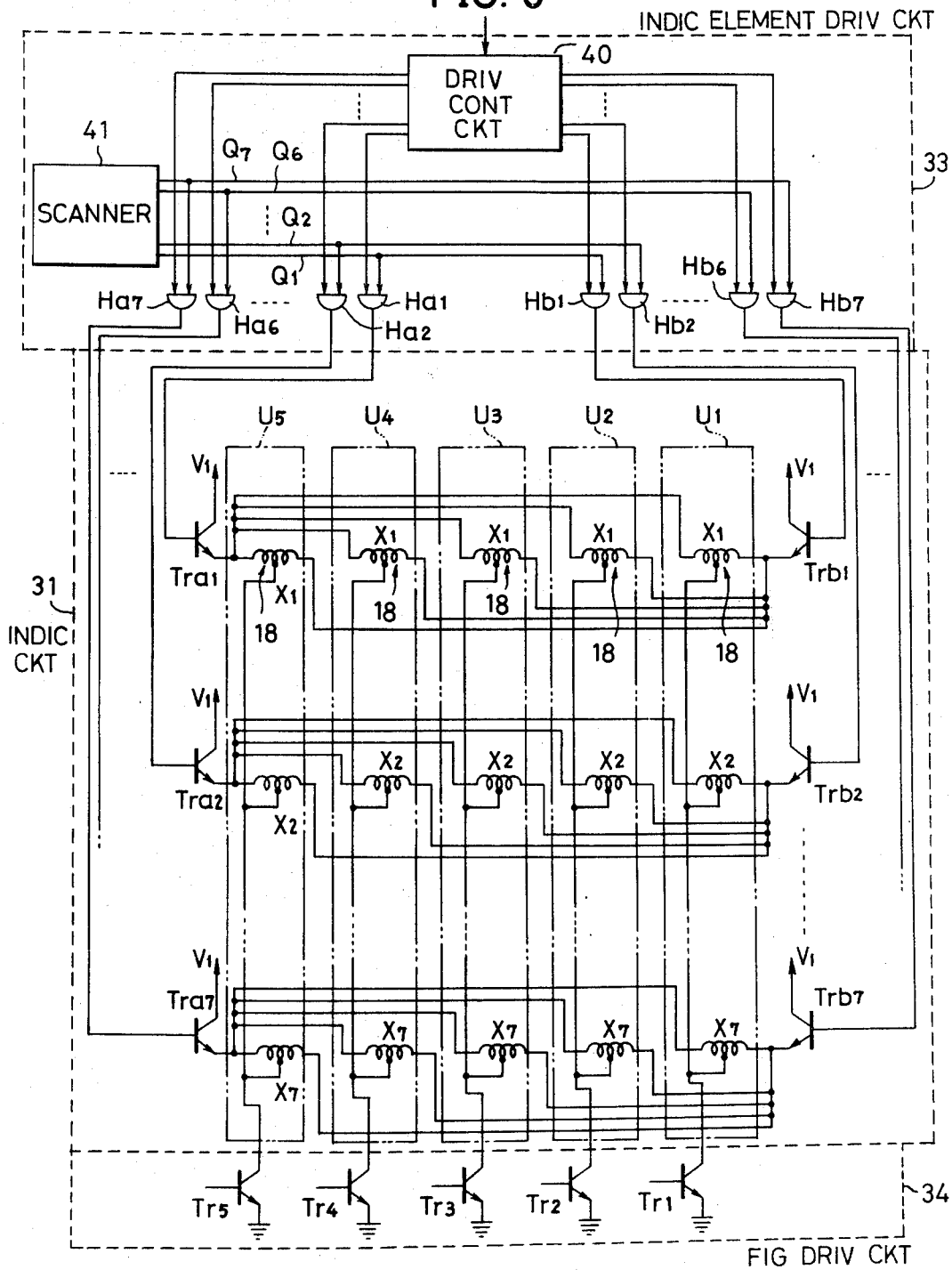
FIG. 6 is a circuit systematic diagram showing, in more detail, a part of circuit system in FIG. 5.

The multiplexers M1 through M5 operate, at the time instant when the scanning signals N1 through N5 are sequentially supplied thereto, to supply sequentially figure indicating signals F1 to F5 to a driving control circuit 40 shown in FIG. 6 in the indicating element driving circuit 33. The Driving control circuit 40 sends out operating signals to seven couples of AND gates Ham and Hbm (where m is an integer among 1 through 7) in such a manner that either one of respective couple of AND gates is supplied with an operating signal and the other one thereof is supplied with an operating signal having opposite phase. That is, in the case where the signal supplied to the AND gates Ha1 through Ha7 is assumed to be 1100101 when a numeral "3" is to be indicated, a signal 0011010 having a phase opposite to the above assumed signal is supplied from the driving control circuit 40 to the AND gates Hb1 through Hb7.

A scanner 41 generates scanning signals sequentially in a time-serial or a time-division manner. Each of the scanning signals has a period of one seventh the scanning signal from the scanner 39. The scanning signals from the scanner 41 are supplied to the AND gates Ha1 through Ha7, and AND gates Hb1 through Hb7. For instance, when a first scanning signal Q1 is supplied from the scanner 41 to the AND gates Ha1 and Hb1, either one of the AND gates Ha1 and Hb1 makes an AND operation with the scanning signal Q1 and the signal from the driving control circuit 40. A output signal of the AND gate is therefore applied to the base of either one of a couple of transistors Tra1 and Trb1 of which collectors are connected to a power source of a voltage V1, whereby either one of the transistors Tra1 and Trb1 is rendered into a conductive state. Similarly as in the preceding case, as the scanner 41 emits sequentially a second through seventh scanning signals Q2 through Q7, either one of each couple of transistors Tra2 through Tra7 and Trb2 through Trb7 is sequentially rendered into a conductive state.

Between each couple of transistors Tram and Trbm (where m is an integer among 1 through 7), five coils Xm of the electromagnets 18 are respectively connected in parallel with each other. The coils X1 through X7 in respective indicating parts U1 through U5 are connected in common at their middle points, which are connected to the collectors of the transistors Tr1 through Tr5 of the figure driving circuit 34 corresponding to respective indicating parts U1 through U5.

On the other hand, the AND gates G1 through G5 in the figure driving circuits 34 are always supplied, at one input terminals thereof, with the signal from the monostable multivibrator 37 and are supplied, at the other input terminals thereof, with the scanning signals N1 through N5 sequentially in a time-serial or division manner. Accordingly, the AND gates G1 through G5 send out outputs sequentially in response to incoming of the scanning signals N1 through N5. These outputs are sequentially applied to the base of the transistors Tr1 through Tr5, whereby the transistors Tr1 through Tr5 are sequentially rendered into conductive. Consequently, the middle points of the coils X1 through X7 of the indicating parts U1 through U5 are sequentially grounded through the transistors Tr1 through Tr5.

In the state where the transistor Tr1 is in a conductive state, the transistors Tra1 or Trb1 is rendered into conductive in response to the scanning signal from the scanner 41, whereby the coil X1 of the indicating part U1 is energized. During the transistor Tr1 is conducting, the coils X2, X3, —,X7 in the indicating part U1 are sequentially energized for 2 msec to 3 msec, for example. Depending upon whether the transistor Tram becomes conductive or the transistor Trbm becomes conductive, the direction of current flowing through the coil 22(Xm) of each electromagnet 18 is determined, whereby the indication of the indicating rod 11 is set white or black in accordance with the current flowing directions. Accordingly, when the transistor Tr1 is conducting, the coils X1 through X7 in the indicating part U1 are sequentially supplied with electric currents in a time-division manner, whereby seven indicating elements 10 of the indicating part U1 are driven, and, the indicating part U1 performs an indication. The coils X1 through X7 are sequentially energized only when the signal is applied to the transistors Tra1 through Tra7, or the transistors Trb1 through Trb7 in sequence, and are not energized in other intervals. However, since the indicating element 10 has a capability of self-holding indication thereof as described hereinbefore, no inconvenience occurs in indication.

Then, when the transistor Tr2 becomes conductive, the coils X1 through X7 in the indicating part U2 are sequentially energized, similarly as in the preceding case, whereby the indicating part U2 makes an indication. As the transistors Tr3, Tr4, and Tr5 become conductive in sequence, the indication part U3, U4, and U5 make sequentially indications, similarly as in the preceding case.

In the present embodiment, the operation of each of indicating parts U1 through U5 is sequentially carried out in a time-division manner in accordance with the signals from the scanner 39, and, furthermore, the operations of seven coils X1 through X7 in each respective indication parts are sequentially carried out in a time-division manner, in accordance with the signals from the scanner 41. For this reason, the frequency of scanning signal from the scanner 41 is selected at seven times that of scanning signal from the scanner 37.

Further, the present invention may be organized so that the operations of respective indicating parts U1 through U5 are sequentially carried out in a time-division manner without using the scanner 41, and seven coils in respective indicating parts are caused to be energized at the same time.

In accordance with the present invention, since the arrangement is made so as to drive each indicating part or indicating element sequentially in a time-division manner, the electric power consumption becomes small. Further, since the current used is sufficient to be a small value, the voltage drop is limited to an extremely small value, even in the case where the indicating circuit 31 is located at a place separated from the fuel quantity operation circuit 32, the indicating element driving circuit 33, and the figure driving circuit 34, whereby the wiring extends long distance. Moreover, in the present embodiment, only the current flowing through the coil of the single electromagnet flows through each transistor Tr1 through Tr5. As a result, the transistor having a small capacity of the same order as that of the transistors Tra1 through Tra7, and Trb1 through Trb2 may be used as the transistors Tr1 through Tr5.

Further, this invention is not limited to these embodiments but various variations and modifications may be made without departing from the scope and spirit of the invention.

What is claimed is:

1. An indicating apparatus comprising: a plurality of indicating parts respectively having a plurality of indicating elements operated to indicate and maintain their indicating states; indicating element driving means provided in respective indicating elemtns and adapted to drive said indicating elements; a first group of transistors provided in correspondence with respective indicating parts and adapted to close and open current supplying lines to respective indicating element driving means for each of said indicating parts; a group of AND gates adapted to carry out ON and OFF control of respective transistors of said first group of transistors; means for sending a signal to said AND gates group interrelatedly with indicating initiation operation; means for generating indicating signals; indicating element driving circuits provided in correspondence with each of said indicating parts; and means for supplying said indicating signal to said indicating element driving circuits sequentially in a time-division manner with a first period, and further for sending a time-division signal to said AND gates group sequentially with the first period, said transistors of said first group of transistors being rendered ON and OFF sequentially in a time-division manner with the first period by means of said AND gates group, and said indicating element driving circuits causing said indicating element driving means to operate sequentially in a time-division manner with a second period which is shorter than the first period.

2. An indicating apparatus as claimed in claim 1 in which said sequentially supplying circuits comprise a scanner for generating scanning signals sequentially in a time-division manner and circuits for supplying said indicating signals to said indicating element driving circuits in sequence in accordance with said scanning signals; and said closing circuits comprise circuits for causing said indicating element driving circuits to be grounded sequentially in accordance with said scanning signals.

3. An indicating apparatus as claimed in claim 1, wherein each of said indicating elements comprises an indicating rod colored in different colors on a peripheral surface thereof and supported in a rotatable manner, a permanent magnet buried in said indicating rod, and a stop member for restricting rotation of said indicating rod at a predetermined position where indication is being normally made; each of said indicating element driving circuits comprising an electromagnet in which the direction of current flowing through a coil is changed over in accordance with said indicating signals and which develops a pole of polarity same to or different from the polarity of said permanent magnet; the longitudinal axis of said permanent magnet being displaced by a small angle with respect to the center line of said electromagnet when rotation of said indicating rod is restricted at said predetermined position.

* * * * *